US006106321A

United States Patent [19]

Yoshida et al.

[11] Patent Number: 6,106,321

[45] Date of Patent: Aug. 22, 2000

[54] INCOMPLETE-ENGAGEMENT PREVENTION TYPE CONNECTOR ASSEMBLY

[75] Inventors: Haruki Yoshida; Motohisa Kashiyama, both of Shizuoka, Japan

[73] Assignee: Yazaki Corporation, Tokyo, Japan

[21] Appl. No.: 08/997,866

[22] Filed: Dec. 24, 1997

[30] Foreign Application Priority Data

Dec. 24, 1996 [JP] Japan ..... 8-343795

[51] Int. Cl.[7] ..... H01R 13/627

[52] U.S. Cl. ..... 439/352; 439/310

[58] Field of Search ..... 439/350, 352–357, 439/310, 488, 489

[56] References Cited

U.S. PATENT DOCUMENTS

| | | | |
|---|---|---|---|
| 4,993,967 | 2/1991 | Matsumoto | 439/352 X |
| 5,183,410 | 2/1993 | Inaba et al. | 439/489 |
| 5,370,543 | 12/1994 | Hamada et al. | 439/352 X |
| 5,820,400 | 10/1998 | Yamanashi et al. | 439/358 |

FOREIGN PATENT DOCUMENTS

| | | | |
|---|---|---|---|
| 5-81967 | 11/1993 | Japan | H01R 13/639 |

*Primary Examiner*—Khiem Nguyen

*Attorney, Agent, or Firm*—Sughrue, Mion, Zinn, Macpeak & Seas, PLLC

[57] ABSTRACT

An incomplete-engagement prevention type connector assembly including male and female connectors which has an incomplete-engagement preventing function and is used, for instance, in an electrical system in an automobile. In the connector assembly, in an engaging section of the male connector an engaging member is protruded in the direction of engagement, and a flexible engaging auxiliary member is provided. The lower surface of the front end portion of the engaging auxiliary member is a sloped surface. Furthermore, in the engaging section, a pair of right and left engaging lock members are protruded. On the other hand, a sloped surface is formed on the upper surface of the housing of the female connector. Behind the sloped surface on the upper surface of the housing, provided are an engaging fixation section adapted to lock the engaging member, and disengaging members adapted to disengaged the male and female connectors from each other. The front end portions of the disengaging members are formed into hook members having tapered surfaces.

13 Claims, 5 Drawing Sheets

INCOMPLETE-ENGAGEMENT PREVENTION TYPE CONNECTOR ASSEMBLY

BACKGROUND OF THE INVENTION

1. Field of the Invention

This invention relates to an incomplete-engagement prevention type connector assembly comprising male and female connectors which has an incomplete-engagement preventing function and is used, for instance, in an electrical system in an automobile.

2. Description of the Related Art

A variety of incomplete-engagement prevention type connector assemblies of this type have been disclosed, and one of the connector assemblies has been disclosed, for instance, in Japanese Utility Model Unexamined Publication No. Hei. 5-81967.

In FIG. 7, reference numeral 41 designates a conventional incomplete-engagement prevention type connector assembly, which is designed as follows: That is, the conventional connector assembly comprises: a male connector 42 which incorporates therein male-type pin contacts 44; and a female connector 43 which incorporates therein female-type socket contacts 45. In the female connector 43, a pair of compression springs 46 are built which urge the male connector 42 in the direction of incomplete-engagement. A pair of lock mechanisms 47 are provided between the male and female connectors 42 and 43.

The male connector 42 is in the form of a rectangular box which is made up of a top plate 43, a bottom plate 49, and right and left side plates 50, thus having front and rear openings. The male connector 42 incorporates therein a plurality of pin contacts 44. As the male connector 42 is engaged with the female connector 43, the pin contacts 44 are inserted into the socket contacts 45 of the female connector 43, respectively; that is, the pin contacts 44 are electrically connected to the socket contacts 45, respectively.

Each of the right and left side plates 50 of the male connector 42 has a cut at the middle. In the cut, a flexible locking piece 51, which forms the lock mechanism 47. The outer end of the locking piece 51 is slightly retracted from the outer (front) end of the side plate 50. The outer end of the locking piece 51 has a locking pawl 52 which is extended inwardly.

A pair of spring accommodating sections 53 are provided on both sides of the female connector 43, which support the rear ends of the compression springs 46 and accommodates the same. In each of the spring accommodating sections 53, a spring guide rod 54 is provided in such a manner that it is extended in the direction of engagement.

A movable cover 55, which is U-shaped opening forwardly and backwardly, embraces the female connector 43 in such a manner that it is slidable back and forth. The movable cover 55 has a pair of spring accommodating sections 56 on both sides thereof which cover the aforementioned spring accommodating sections 53, respectively. The front end portions of the spring accommodating sections 56 are urged forwardly by the front ends of the compression springs 46.

The right and left side plates of the female connector 43 have locking grooves 57, which form the locking mechanisms 47. The top plate of the movable cover 55 has a pair of elongated holes 58, while the top plate of the female connector 43 has a pair of protrusions 59. The protrusions 59 are engaged with the elongated holes 58, respectively, to regulate the forward movement of the movable cover 55 which are caused by the urging forces of the compression springs 46.

The incomplete-engagement prevention type connector assembly 41 functions as follows: When the male and female connectors 42 and 43 are engaged with each other, the locking pawls 52 are caused to ride on the side plates 60 of the female connector 43 while outwardly bending the locking pieces 51. As a result, the ends of the locking pieces 51 and the locking pawls 52 are abutted against the front end faces of the spring accommodating sections 56 of the movable cover 55, so that the movable cover 55 is moved backwardly while compressing the compression springs 46.

When the male and female connectors 42 and 43 are further engaged with each other, the compression springs 64 are further compressed, and the locking pawls 52 are engaged with the locking grooves 57, so that the locking pieces 51 are restored while the front ends of the locking pieces 51 are disengaged from the front end faces of the spring accommodating sections 56 of the movable cover 55. When a force of compression to engage the connectors with each other is removed, the movable cover 55 is returned to the original position by the urging forces of the compression springs 46, so that the male and female connectors 42 and 43 are completely engaged with each other, and accordingly the pin contacts 44 are completely connected to the socket contacts 45.

Under this condition, the outer surface of the male connector 42 is abutted against the inner surface of the spring accommodating sections 56 of the movable cover 55, and therefore the locking pieces 51 cannot be bent outwardly. Accordingly, the locking pawls 52 will not be disengaged from the locking grooves 57. That is, the male and female connectors 42 and 43 are completely locked by means of the locking mechanisms 47.

When, in the case where the male and female connectors 42 and 43 are incompletely engaged with each other which are so designed that the locking pawls 52 are engaged with the locking grooves 57, the force of compression for engagement is decreased or eliminated, then the male and female connectors 42 and 43 are moved away from each other by the urging forces of the compression springs 64. That is, it can be detected positively whether or not the male and female connectors 42 and 43 have been completely engaged with each other.

However, the above-described conventional incomplete-engagement prevention type connector assembly 41 suffers from the following difficulties: If the movable cover 55 is held during engagement, the engagement of the male and female connectors cannot be achieved. Furthermore, if, after the engagement of the male and female connectors, an unexpected external force is applied to the movable cover 55, the movable cover may be moved, so that the force of maintaining the male and female connectors engaged with each other is decreased.

In order to disengage the male and female connectors 42 and 43 from each other, the worker must bend the locking pieces 51 while pulling the movable cover 55 backwardly of the female connector 43 against the urging forces of the compression springs 46 to disengage the locking pawls 52 from the locking grooves 57. That is, the conventional incomplete-engagement prevention type connector assembly is low in operating performance.

SUMMARY OF THE INVENTION

In view of the foregoing, an object of the invention is to provide an incomplete-engagement prevention type connector assembly comprising male and female connectors in which, when the male and female connectors are engaged with each other, the incomplete engagement of the male and female connectors is positively prevented, and even if, after the engagement of the connectors, an unexpected external force is applied thereto, the male and female connectors are not disengaged from each other, and the engagement of the connectors with each other and the disengagement of the connectors from each other can be achieved with ease.

In order to achieve the above object, the invention provides an incomplete-engagement prevention type connector assembly: a male connector having male terminals inserted in its housing; a female connector having female terminals inserted in its housing; and a lock mechanism for engaging the male and female connectors with each other, wherein an engaging member for engaging the female connector with the male connector, and an engaging auxiliary member for assisting an engaging function of the engaging member are provided in an engaging section of the male connector, and wherein a sloped surface for guiding the engaging auxiliary member, an engaging fixation section for locking the engaging member, and swingable disengaging members are provided on an outer wall of the female connector.

DETAILED DESCRIPTION OF THE PREFERRED EMBODIMENT

An incomplete-engagement prevention type connector assembly, which constitutes a preferred embodiment of the invention, will be described with reference to the accompanying drawings.

Figure 1:
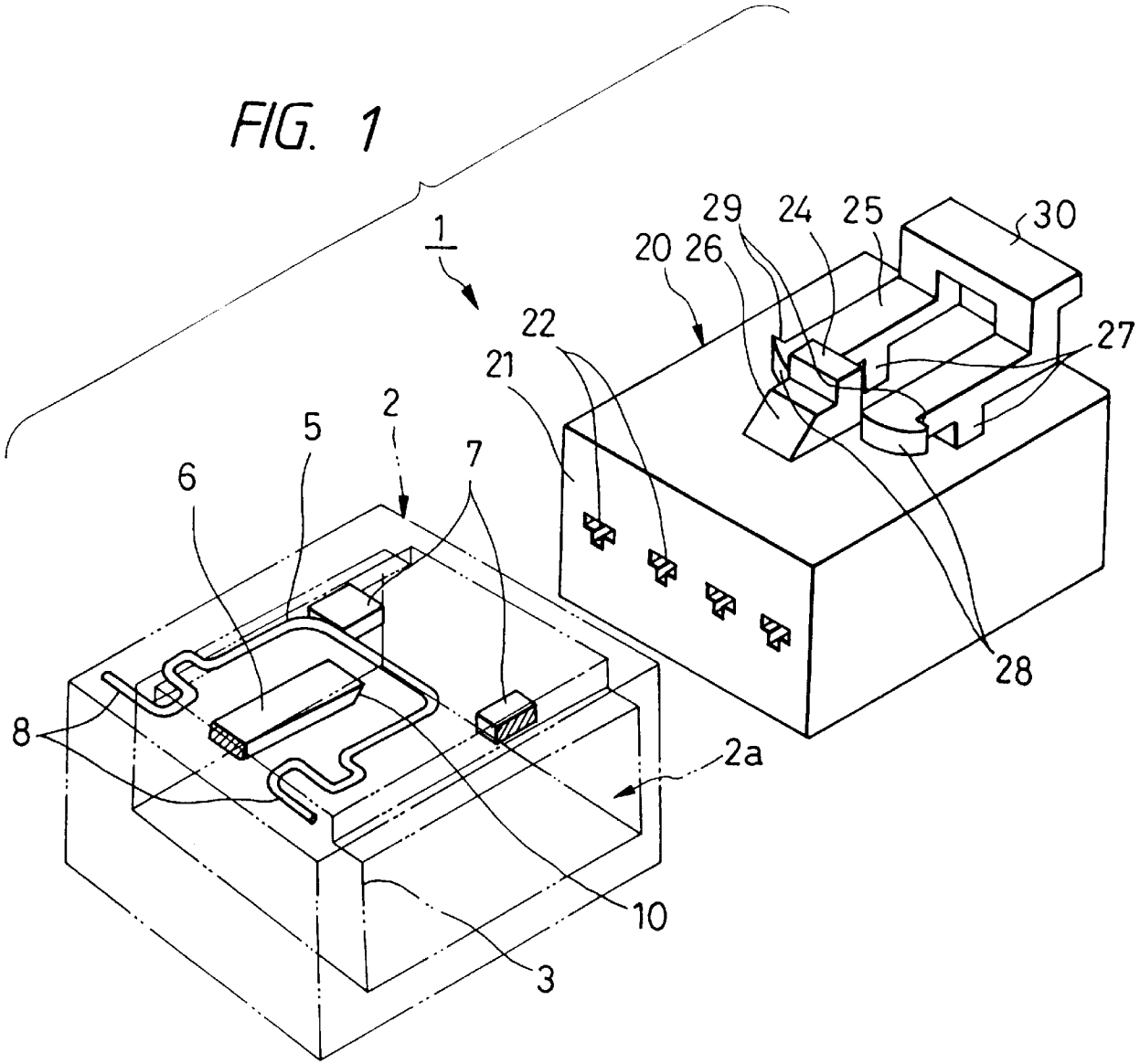
FIG. 1 is an exploded perspective view outlining the arrangement of an example of an incomplete-engagement prevention type connector assembly, which constitutes an embodiment of the invention.

In FIG. 1, reference numeral 1 designates the incomplete-engagement prevention type connector assembly, the embodiment of the invention. The incomplete-engagement prevention type connector assembly comprises a male connector 2 and a female connector 20 which are to be engaged with each other. The male connector 2 has a housing which has an engaging section 2*a* which is opened in the direction of engagement. An inner surface 3 of the rear end wall of the housing, which defines the engaging section 2*a*, is confronted with the female connector (hereinafter referred to as "confronting surface 3", when applicable), and has a plurality of male terminals 4 such as pin contacts (cf. FIG. 2).

Figure 6:
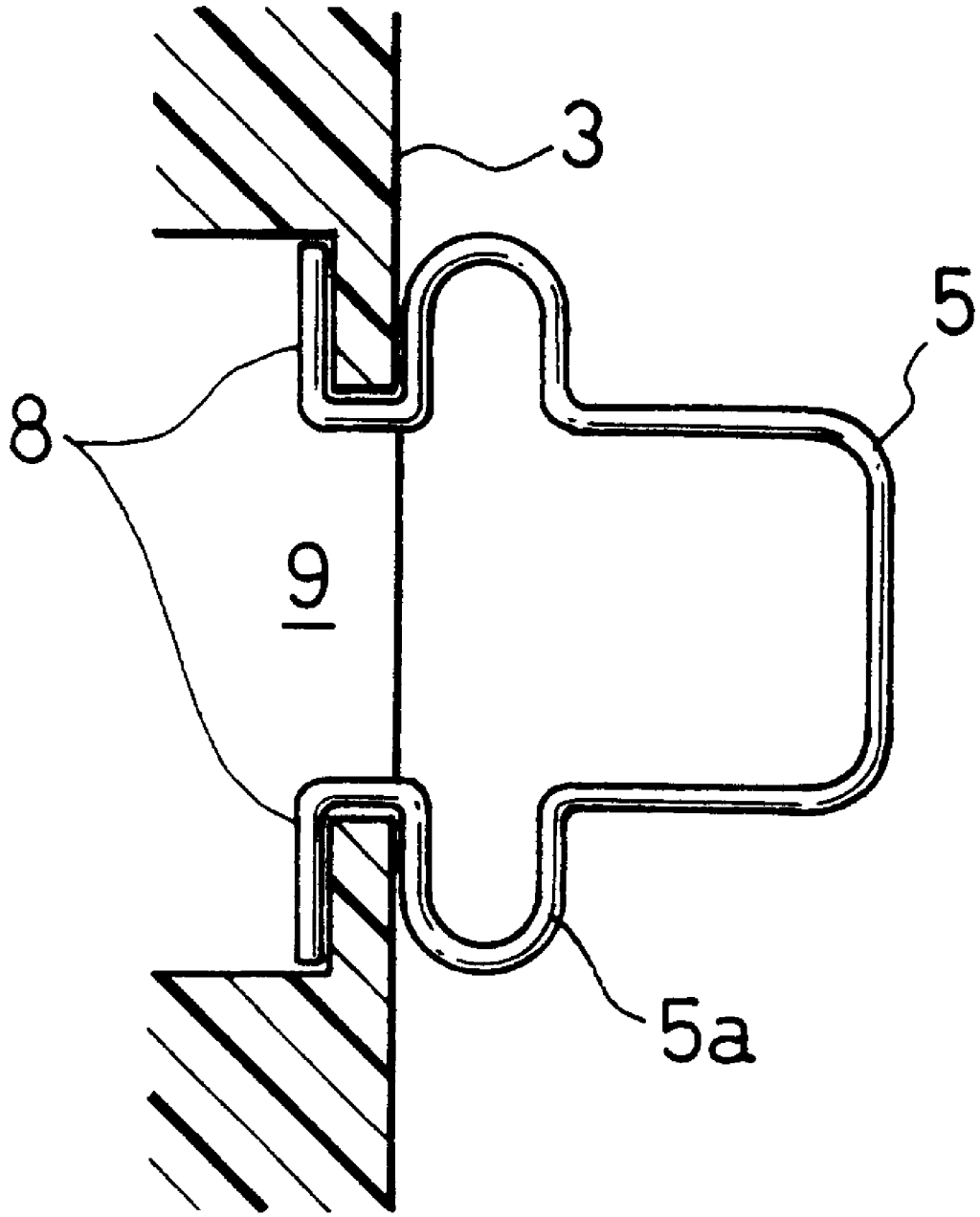
FIG. 6 is a plan view showing an engaging member of the male connector.
Figure 7:
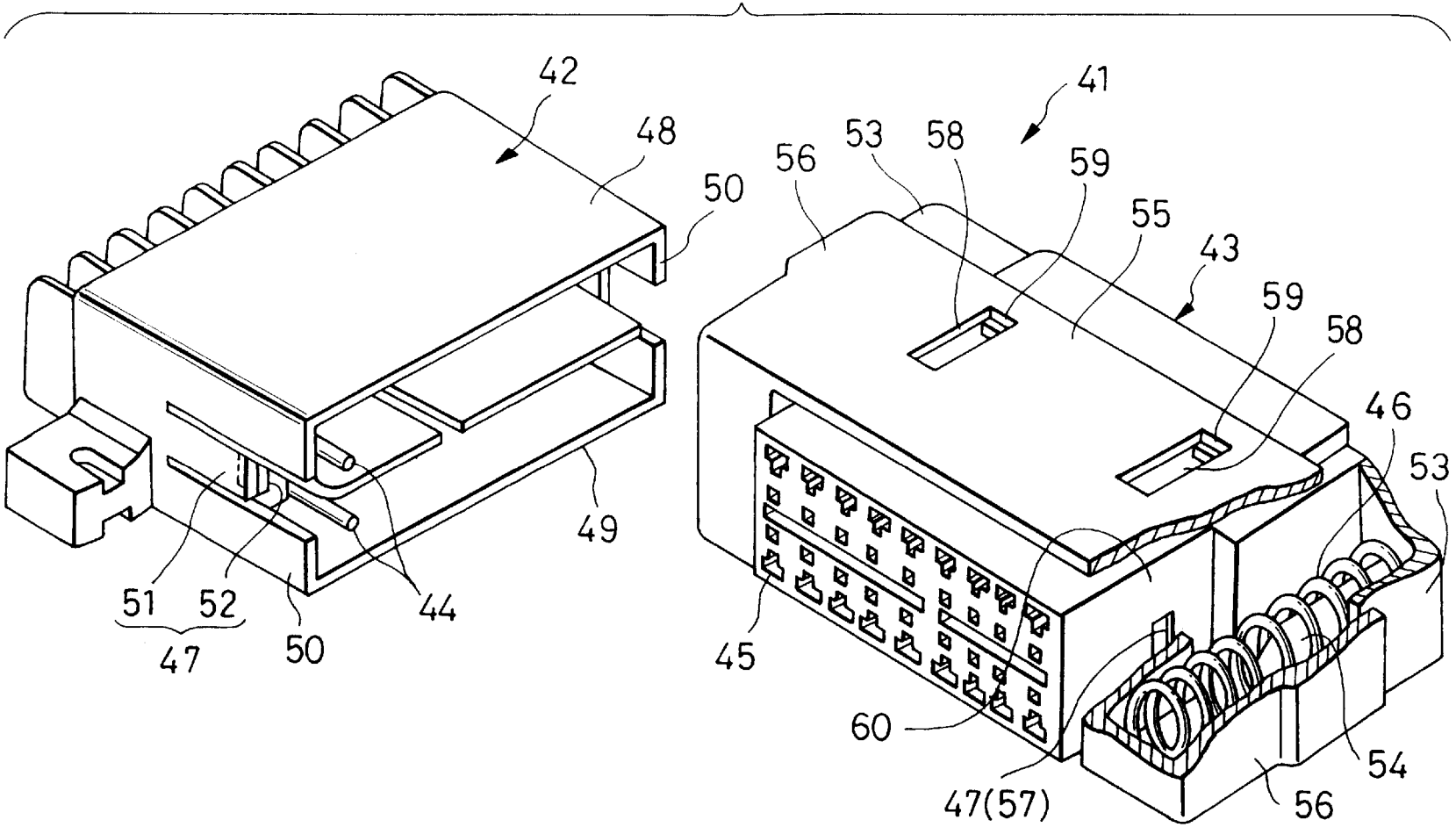
FIG. 7 PRIOR ART
FIG. 7 is an exploded perspective view outlining the arrangement of a conventional incomplete-engagement prevention type connector assembly.

Furthermore, as shown in FIG. 6, on the confronting surface 3 an engaging member 5 made of a spring wire material is provided in such a manner that it is protruded in the direction of engagement with its both end portions 8 and 8 locked to the end wall of the housing. In addition, on the confronting surface 3, a flexible engaging auxiliary member 6 is provided. A pair of engaging lock members 7 and 7 are protruded from the inner surfaces of the right and left side walls of the engaging section 2*a*.

The engaging member 5 is made of a metal spring wire material, and its both end portions 8 and 8 are fixedly set in a groove 9 which is formed in the confronting surface 3. Furthermore, the engaging member 5 has a pair of curved spring sections 5*a* at the end portions thereof which are protruded in the engaging section 2*a*. A lower surface 10 of the end portion of the engaging auxiliary member 6 is sloped (hereinafter referred to as "sloped surface 10", when applicable).

On the other hand, a plurality of terminal insertion holes 22 are formed in a confronting surface 21 of the female connector 20 which is confronted with the male connector 2. A plurality of female terminals such as socket contacts are inserted into the terminal insertion holes 22. On the upper surface of the housing, a sloped surface 26 is formed to displace the engaging auxiliary member 6 of the male connector 2 upwardly with the engagement of the connectors.

Furthermore, behind the sloped surface 26 on the upper surface of the housing of the female connector 20, provided are an engaging fixation section 24 adapted to lock the engaging member 5, and disengaging members 25 adapted to disengage the male and female connectors 2 and 20 from each other.

The disengaging members 25 which are substantially U-shaped are provided on the upper surface of the housing in such a manner that their end portions are swingable about supports 27 and 27, respectively. The front end portions of the disengaging members 25 have hooks 29 and 29 which have tapered surfaces 28 and 28, respectively, which are sloped outwardly of the members 25. The remaining end portions are formed into an operating section 30 which is operated to disengage the male and female connectors from each other.

Next, the engagement of the incomplete-engagement prevention type connector assembly thus constructed, will be described.

Figure 2:
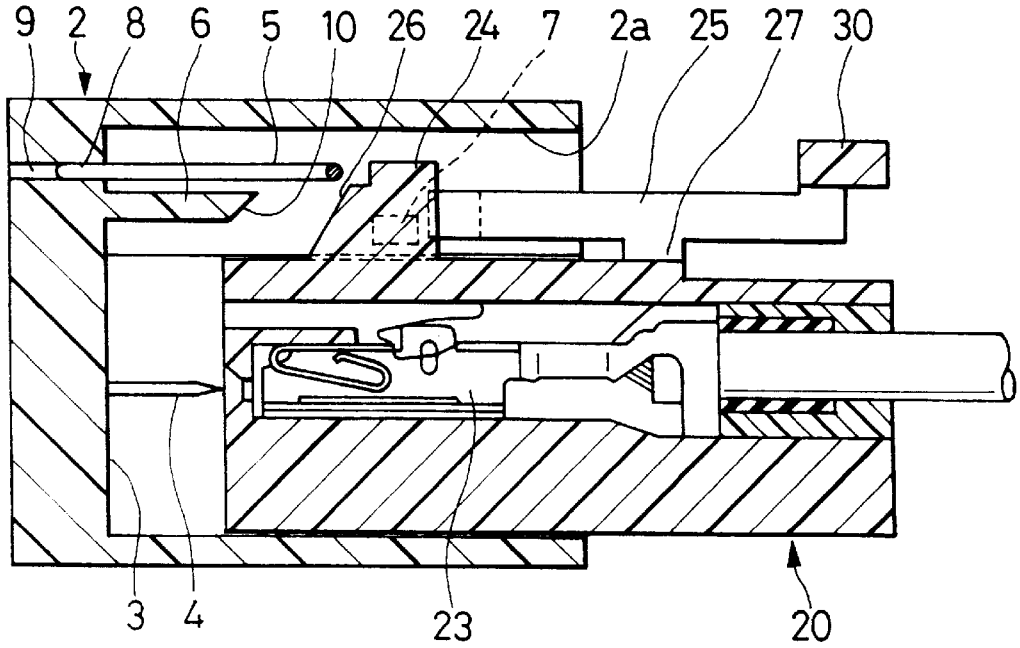
FIG. 2 is a sectional view showing male and female connectors which are not engaged with each other yet.

As shown in FIG. 2, the female connector 20 is inserted into the engaging section 2*a* of the male connector 2 so that the male terminals 4 of the male connector 2 are inserted into the female terminal 23 of the female connector 20.

Figure 3:
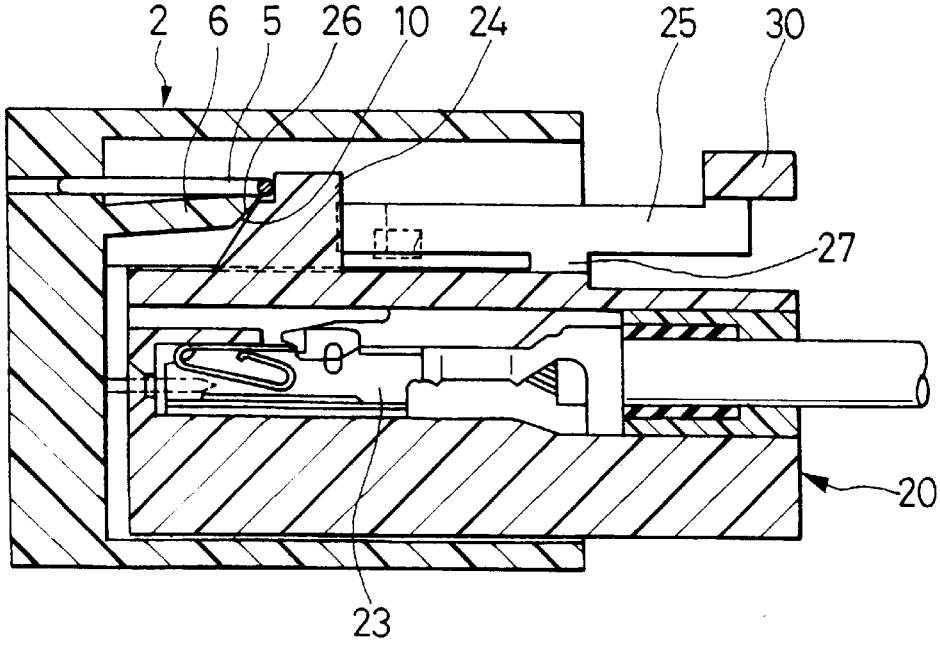
FIG. 3 is a sectional view showing the male and female connectors which are being engaged with each other.

As shown in FIG. 3, when, with the male terminals 4 of the male connector 2 inserted into the female terminals 23 of the female connector 20, the male and female connectors 2 and 20 are further engaged with each other, then the end of the engaging member 5 is abutted against the front wall of the engaging fixation section 24 of the female connector 20. When the male and female connectors are further engaged with each other against the elastic force of the engaging member 5, then the sloped surface 10 of the end portion of the engaging auxiliary member 6 abuts against the sloped surface 26 of the female connector 20, so that the front end portion of the engaging auxiliary member 6 is bent upwardly.

If, under this condition, the connector engaging work is stopped, the male and female connectors are restored by the elastic force of the engaging member 5; that is, they are returned to be disengaged from each other.

Figure 4:
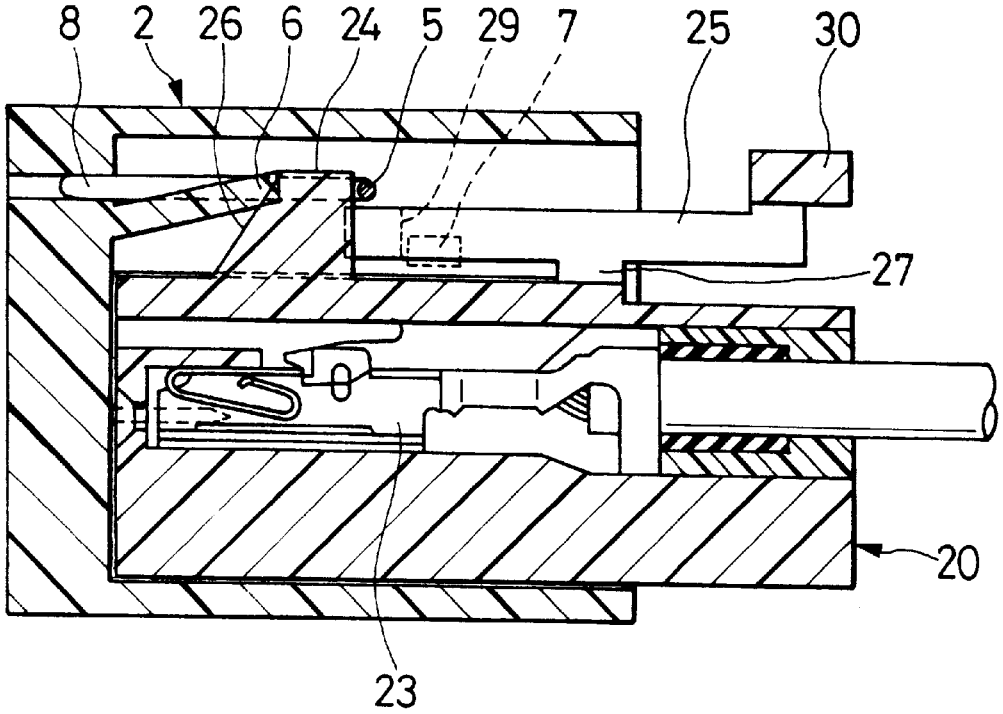
FIG. 4 is a sectional view showing the male and female connectors which have been completely engaged with each other.

When, as shown in FIG. 4, the male and female connectors 2 and 20 are further engaged with each other, the end portion of the engaging auxiliary member 6 of the male connector 2 is bent upwardly by the sloped surface 26 of the female connector 20, so that the end portion of the engaging auxiliary member 6 bends the end portion of the engaging member 5 upwardly which is arranged above the engaging auxiliary member 6, and the engaging member 5 moves over the upper surface of the engaging fixation section 24, and is locked being caught by the engaging fixation section 24.

In this operation, the pair of engaging lock members 7 and 7 of the male connector 2 abut against the tapered surfaces 28 and 28 (cf. FIG. 1) which are the front end surfaces of the disengaging members 25 of the female connector 20. Further, the engaging lock members 7 and 7 move over the tapered surfaces 28 and 28 from both sides, thus being locked to the hooks 29 and 29.

That is, the engaging member 5 is locked to the engaging fixation section 24, while the engaging lock members 7 and 7 are locked to the hooks 29 and 29. Hence, the male and female connectors 2 and 20 are completely engaged with each other, while the male terminals 4 of the male connector 2 are inserted into the female terminals 23 of the female connector 20; that is, the male terminals 4 and the female terminals 23 are electrically connected to each other.

Now, the disengagement of the male and female connectors 2 and 20 which have been completely engaged with each other, will be described.

Figure 5:
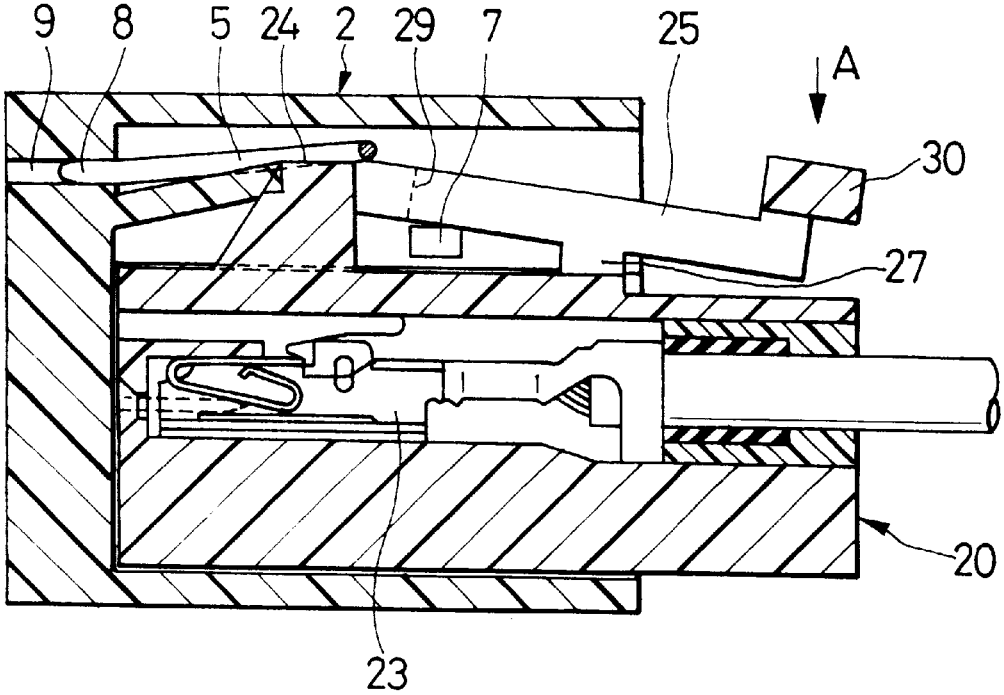
FIG. 5 is a sectional view showing the male and female connectors which are being disengaged from each other.

First, as shown in FIG. 5, the operating section 30 of the disengaging members 25 of the female connector 20 is depressed in the direction of the arrow A. As a result, the front end portions of the disengaging members 25 are swung upwardly, so that the engaging member 5 locked to the engaging fixation section 24 is moved upwardly. Then, the end portion of the engaging member 5 is disengaged from the engaging fixation section 24, while the hooks 29 and 29 of the front end portions of the disengaging members 25 are disengaged from the engaging lock members 7 and 7 of the male connector 2. Thus, the male and female connectors may be pulled in the opposite directions so as to be disengaged from each other, so that the male terminals 4 of the male connector 2 are pulled out of the female terminals 23 of the female connector 20; that is, the male terminals 4 and the female terminals 23 are electrically disconnected from each other. Thus, the male and female connectors 2 and 20 are completely disengaged from each other.

As was described above, in the incomplete-engagement prevention type connector assembly, the male terminal has the engaging section which incorporates the engaging member for engaging the female connector with the male connector, and the engaging auxiliary member for assisting the engaging function of the engaging member, and the sloped surface for guiding the engaging auxiliary member, the engaging fixation section for locking the engaging member, and the swingable disengaging members are provided on the outer wall of the female connector.

Furthermore, the engaging lock members for locking the disengaging members of the female connector are provided in the engaging section of the male connector, and the disengaging members have the flexible engaging hooks.

Moreover, the engaging member is made of a spring wire material, the pair of the engaging lock members are protruded from the inner surface of the engaging section of the male connector in such a manner that the engaging lock members are confronted with each other, the pair of the disengaging members are provided in such a manner that the disengaging members are in parallel with each other in the direction of engagement of the male and female connectors, and the front ends of the engaging hooks are formed into tapered surfaces.

Hence, when engaged with each other, the male and female connectors are double-locked by means of the engaging member and the engaging locking members of the male connector and the engaging fixation member and the engaging hooks of the disengaging members of the female connector. When it is required to disengage the male and female connectors from each other, the disengagement can be readily achieved merely by depressing the operating section of the disengaging members formed on the female connector.

In the case where the male and female connectors are not completely engaged with each other, the male and female connectors are moved away from each other by the elastic force of the engaging member of the male connector. Hence, it can be positively detected whether or not the male and female connectors have been completely engaged with each other. Therefore, the incomplete-engagement prevention type connector assembly is improved in operation during maintenance, and high in reliability.

What is claimed is:

1. An incomplete-engagement prevention type connector assembly comprising:

a male connector having male terminals inserted in a male connector housing;

a female connector having female terminals inserted in a female connector housing;

an engaging member for engaging said female connector with said male connector;

an engaging auxiliary member for temporarily deflecting said engaging member;

a sloped surface for guiding said engaging auxiliary member so as to cause said engaging auxiliary member to deflect said engaging member;

an engaging fixation section for locking said engaging member; and a swingable disengagable member for disengaging said engaging member from said engaging fixation section, wherein each of said engaging member and said engaging auxiliary member is provided on said male connector and each of said sloped surface, said engaging fixation section and said disengaging member is provided on an outer wall of said female connector.

2. The incomplete-engagement prevention type connector assembly as claimed in claim 1, wherein engaging lock members for locking said disengaging members of said female connector are provided in an engaging section of said male connector, and flexible engaging hooks are provided with said disengaging members.

3. The incomplete-engagement prevention type connector assembly as claimed in claim 2, wherein said engaging member is made of a spring wire material, a pair of said engaging lock members are protruded from an inner surface of the engaging section of said male connector in such a manner that said engaging lock members are confronted with each other, a pair of said disengaging members are provided in such a manner that said disengaging members are in parallel with each other in a direction of engagement of said male and female connectors, and tapered surfaces are provided with front ends of said engaging hooks.

4. The incomplete-engagement prevention type connector assembly as claimed in claim 1, wherein a sloped surface to be abutted against the sloped surface of said female connector is provided with an end portion of said engaging auxiliary member.

5. The incomplete-engagement prevention type connector assembly as claimed in claim 1, wherein said disengaging members are provided in such a manner that both end portions of said disengaging members are swingable about supports.

6. An incomplete-engagement prevention type connector assembly comprising:

a male connector having male terminals inserted in a male connector housing;

a female connector having female terminals inserted in a female connector housing; and a lock mechanism for engaging said male and female connectors with each other, wherein an engaging member for engaging said female connector with said male connector, and an engaging auxiliary member for assisting an engaging function of said engaging member are provided in an engaging section of said male connector, wherein a sloped surface for guiding said engaging auxiliary member, an engaging fixation section for locking said engaging member, and swingable disengagable members are provided on an outer wall of said female connector, and wherein engaging lock members for locking said disengaging members of said female connector are provided in the engaging section of said male connector, and flexible engaging books are provided with said disengaging members.

7. The incomplete-engagement preventing type connector assembly as claimed in claim 6, wherein said engaging member is made of a spring wire material, a pair of said engaging lock members are protruded from an inner surface of the engaging section of said male connector in such a manner that said engaging lock members are confronted with each other, a pair of said disengaging members are provided in such a manner that said disengaging members are in parallel with each other in a direction of engagement of said male and female connectors, and tapered surfaces are provided with front ends of said engaging hooks.

8. An incomplete-engagement prevention type connector assembly comprising:

a male connector having male terminals inserted in a male connector housing;

a female connector having female terminals inserted in a female connector housing; and a lock mechanism for engaging said male and female connectors with each other, said lock mechanism including:

a springing lock wire with both ends of said springing lock wire disposed in said male connector;

a flexible member disposed in said male connector between said ends of said springing lock wire; and a fixed member disposed on said female connector, said fixed member having a sloped surface for said flexible member to slide upon, and said fixed member being aligned to abut with said springing latch wire;

wherein prior to said male and female connector being fully engaged, said flexible member slides upon said slope member to temporarily deflect said springing lock wire to lock with said fixed member, causing full engagement for said male and female connectors; and wherein if said male and female connectors are not connected, said springing lock wire urges away said fixed member.

9. The incomplete-engagement preventing type connector assembly as claimed in claim 8, wherein said flexible member includes a sloped end for sliding upon said sloped surface of said fixed member.

10. The incomplete-engagement preventing type connector assembly as claimed in claim 8, further comprising a disengaging member disposed on said female connector adjacent to said fixed member and engaging lock members disposed on said male connector.

11. The incomplete-engagement preventing type connector assembly as claimed in claim 10, wherein said disengaging member includes a pair of hooks for hooking with said engaging lock members.

12. The incomplete-engagement preventing type connector assembly as claimed in claim 10, wherein said disengaging member includes an operating section and swinging supports so that when a force is applied on said operating section after full engagement of said male and female connectors said swinging supports allow said hooks to elevate above said lock members while said disengaging members simultaneously lift said springing lock wire above said fixed member, allowing said male and female connectors to be freely disengaged.

13. A connector arrangement, comprising:

a first connector;

a second connector mateable with said first connector, said second connector including a locking projection;

a spring locking device disposed on said first connector and engageable with said locking projection when said first and second connectors are completely engaged with each other, wherein said spring locking device is deflected as said first and second connectors are mated with each other over a predetermined stroke so as to urge said connectors away from each other.

* * * * *